US007575458B2

(12) United States Patent
Parmeter et al.

(10) Patent No.: US 7,575,458 B2
(45) Date of Patent: Aug. 18, 2009

(54) HI-DIELECTRIC DEBRIS SEAL FOR A POTHEAD INTERFACE

(75) Inventors: Larry J. Parmeter, Broken Arrow, OK (US); Brett D. Leamy, Claremore, OK (US); Steven K. Tetzlaff, Owasso, OK (US); Brad E. Yingst, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/853,965

(22) Filed: Sep. 12, 2007

(65) Prior Publication Data

US 2008/0064269 A1 Mar. 13, 2008

Related U.S. Application Data

(60) Provisional application No. 60/844,051, filed on Sep. 12, 2006.

(51) Int. Cl.
*H01R 13/52* (2006.01)

(52) U.S. Cl. ..... 439/271; 439/587

(58) Field of Classification Search ..... 439/271, 439/587

See application file for complete search history.

(56) References Cited

U.S. PATENT DOCUMENTS

| | | | | |
|---|---|---|---|---|
| 3,980,369 | A * | 9/1976 | Panek | 439/204 |
| 4,679,875 | A * | 7/1987 | Ramsey | 439/604 |
| 5,221,214 | A | 6/1993 | Martin | |
| 5,567,170 | A * | 10/1996 | Kroeber | 439/186 |
| 5,700,161 | A * | 12/1997 | Plummer et al. | 439/587 |
| 5,873,750 | A | 2/1999 | Cairns et al. | |
| 6,361,342 | B1 | 3/2002 | Cox | |
| 6,409,485 | B1 | 6/2002 | Ebner | |
| 6,443,780 | B2 | 9/2002 | Wilbourn et al. | |
| 6,676,447 | B1 | 1/2004 | Knox | |
| 7,040,909 | B2 | 5/2006 | Cairns | |
| 2003/0194896 | A1 * | 10/2003 | Fetcenko et al. | 439/271 |

* cited by examiner

*Primary Examiner*—Tho D Ta
(74) *Attorney, Agent, or Firm*—Bracewell & Giuliani LLP

(57) ABSTRACT

A connector for connecting electrical power to a well pump motor has cable and motor connector portions that mate with each other in a connected position. The connector portions have insulating members, each of which has a number of passages and an end face. Electrical contact members are mounted in each of the passages. The ones in the cable connector portion protrude past the end face of the insulating member. An end face seal surrounds each of the protruding contact members and is deformed by engagement of the end face of the motor insulating member when the cable and motor connector portions are in the connected position.

16 Claims, 5 Drawing Sheets

HI-DIELECTRIC DEBRIS SEAL FOR A POTHEAD INTERFACE

CROSS-REFERENCE TO RELATED APPLICATION

This application claims priority to provisional patent application Ser. No. 60/844,051, filed Sep. 12, 2006.

FIELD OF THE INVENTION

This invention relates in general to downhole electrical connectors for use in electrical submersible pump applications, and in particular to a downhole pothead connector for use in oil wells.

BACKGROUND OF THE INVENTION

Electrical submersible pumps have been used in oil wells to pump well fluids for many years. These pumps are part of an assembly that includes a submersible motor. The pump assembly is typically suspended on tubing, and a power cable from the surface is strapped alongside the tubing. A motor lead is secured to the lower end of the power cable, the motor lead terminating in a connector that plugs into a receptacle of the motor. This connector is typically known as a pothead connector.

The motor is filled with a dielectric lubricant that is sealed from the exterior at the receptacle. The connector has seals that seal the electrical conductors from well fluid. A variety of connectors are known. In one type, the cable portion of the connector has a housing that contains two rigid insulating members separated by a deformable insulating member. Passages extend through the members for sealingly receiving the insulated electrical conductors. Electrical contact members or pins connect to the conductors and protrude past the forward insulating member. The remaining portion of the housing is filled with an epoxy.

The receptacle portion of the connector has a rigid insulating member with passages for receiving insulated conductors from the motor. Electrical contact members, typically sleeves, are located in the passages in the insulating member. When the cable portion of the connector is connected to the receptacle, the electrical contact pins slide into the electrical contact sleeves.

Even though this type of connector works well, in the motor lubricant becomes contaminated, debris from the oil can encroach into the connector and come into contact with the electrical contact members. The debris can cause electrical arcing in this region.

SUMMARY

The connector of this invention has end face elastomeric seals surrounding each of the electrical contact pins. Each end face seal has an inner diameter in sealing contact with the contact pin and a rearward side in abutment with the end face of the rigid cable insulating member. When connected, the end face of the motor insulating member contacts the end face seals and deforms them against the opposite end face.

Also, in the embodiment shown, a metal sleeve surrounds part of the protruding portion of each contact pin. The sleeve does not extend past the end face of the cable insulating member as far as the pins. A sleeve seals is fitted around each pin at the rim of the sleeve to prevent entry of debris between the sleeve and the pin. The electrical contact sleeves in the receptacle abut the sleeve seals to cause them to seal against the rims of the pin sleeves.

DETAILED DESCRIPTION OF THE INVENTION

Figure 1:
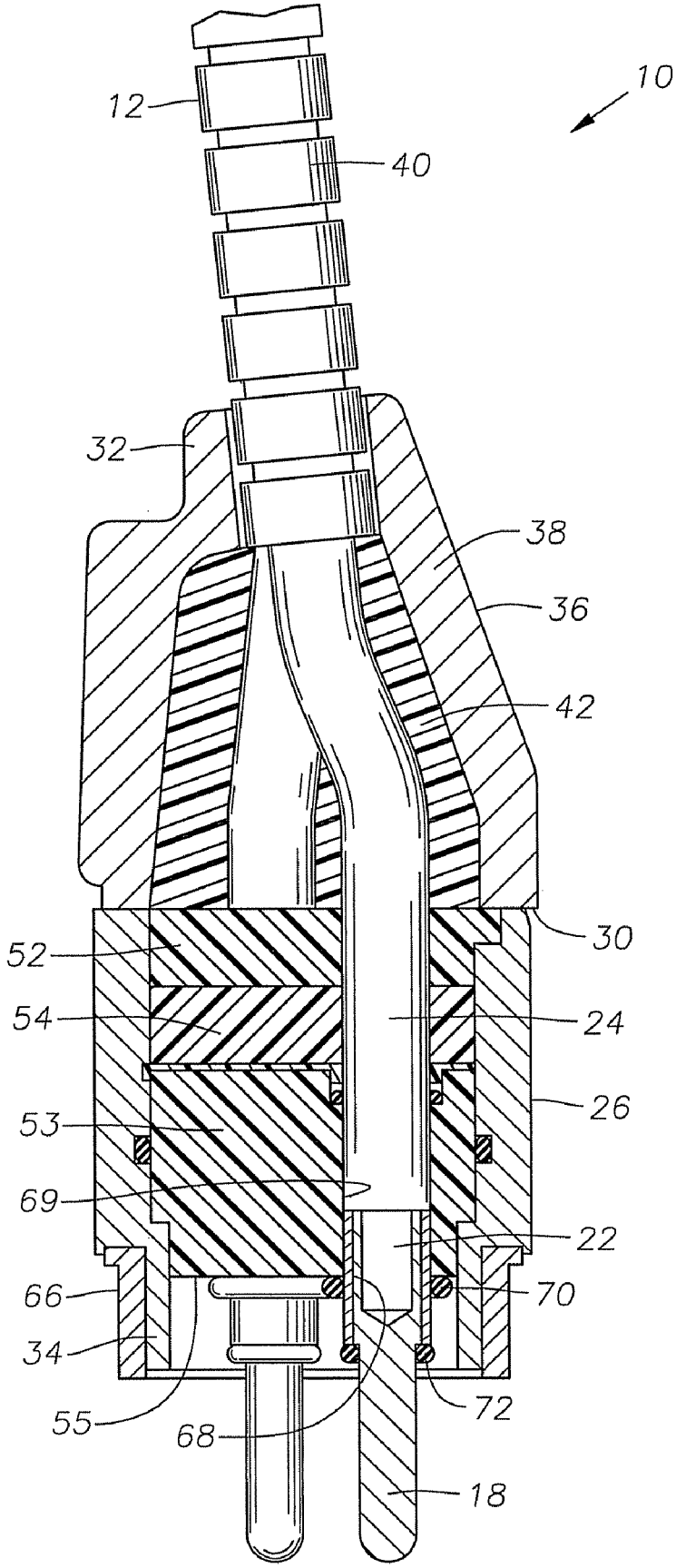
FIG. 1 is a longitudinal sectional view and depicts the interior of the pothead connector made according to an embodiment of the present invention, mounted to the terminal end of the flat downhole electric cable.

FIG. 1 is a longitudinal section view and depicts the interior of the pothead connector 10 made according to an embodiment of the present invention, mounted to the terminal end of a motor lead 12. The upper or rearward end of motor lead 12 is joined to an electrical cable extending to the surface of the well.

Figure 2:
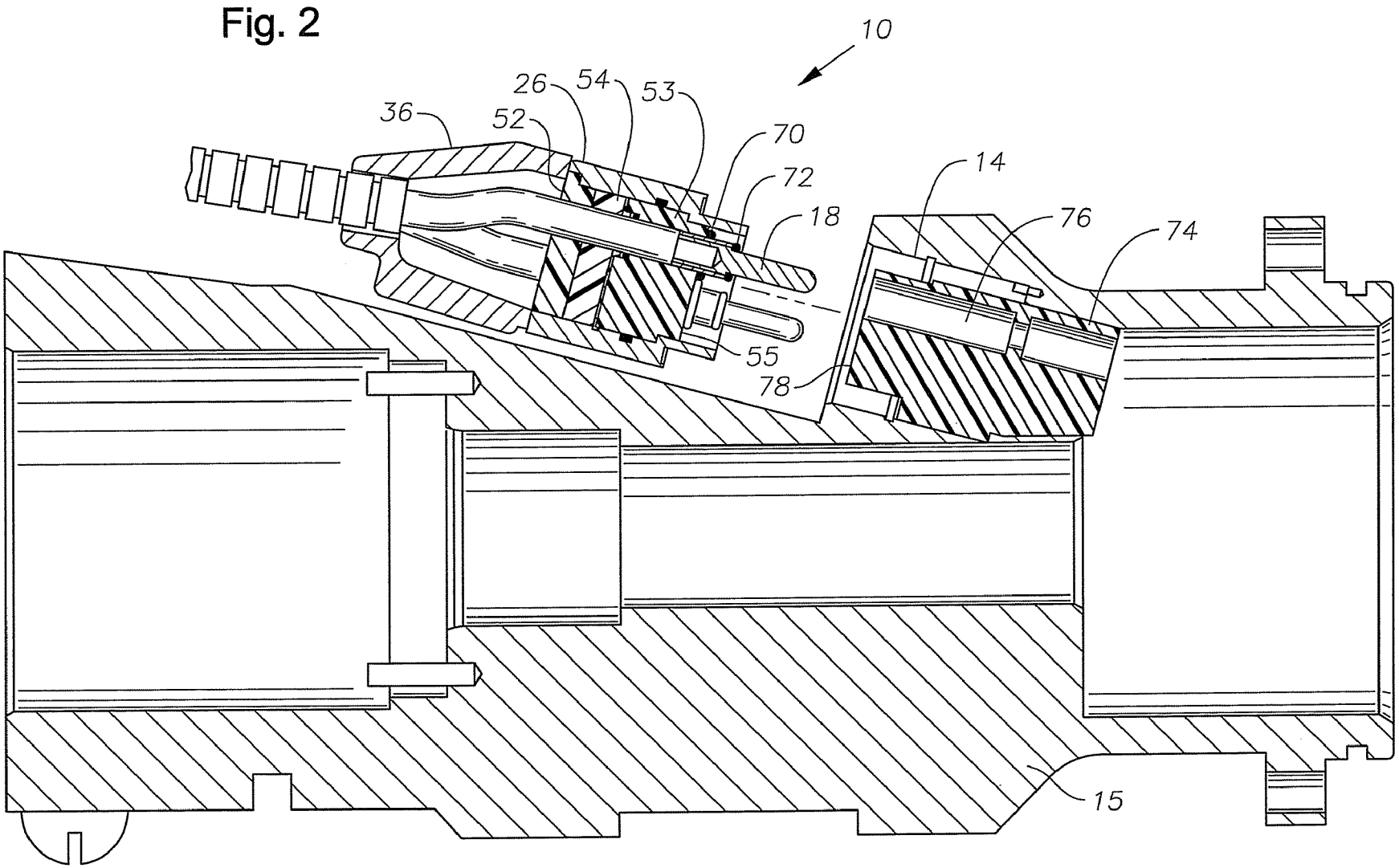
FIG. 2 is a side view of the pothead connector made according to an embodiment of the present invention entering a female assembly.

Pothead connector 10 may have a wide variety of components. However, in this example, pothead connector 10 has a tubular housing 30 with a rearward end 32 through which cable 12 passes and a forward end 34 through which electrical conductor pins 18 extend. Pins 18 electrically connect to a female receptacle 14 of a down hole electrical submersible motor 15 (FIG. 2). Tubular housing 30 preferably comprises two opposite end pieces, base 26 and cap 36. Base 26 provides forward end 34, and cap 36 provides rearward end 32.

Referring to FIG. 1, cap 36 of tubular housing 30 has a tapered tubular end 38 which extends around the exterior of armor 40 of motor lead 12. The interior of cap 36 is filled with epoxy 42, which acts as a retaining means to secure conductor pins 18 within cap 36 in alignment for extending into base 26. Epoxy 42 is a type of epoxy that is rated high for temperature service. The interior surface of the tapered tubular end 38 has a conical profile, with the rearward end periphery being smaller than the forward end periphery. After cap 36 is fastened to base 26 and epoxy 42 is cured, epoxy 42 will provide a conically shaped layer that is aligned within the conical profile of tapered tubular end 38 and prevents movement of cap 36 and base 26 inward over armor 40 of motor lead 12.

As shown in FIG. 1, armor 40 has been stripped back from the terminal end of electrical power cable 12, so that armor 40 has a terminal end enclosed within the tapered tubular end 38 of cap 36. Preferably, each bare electrical conductor 22 is surrounded by one or more layers of conductor insulation 24 to protect and insulate the conductors from one another.

Insulation layers 24 will preferably extend within epoxy layer 42 so that the epoxy of layer 42 will bond directly to insulation layers 24. The insulation layer 24 of each conductor 33 extends sealingly through a rearward rigid insulator member 52, as shown in FIG. 1, and through a deformable elastomeric seal member 54. In this example, seal member 54 is deformed between rearward insulation member 52 and a rigid forward insulation member 53. Insulation layer 24 of each conductor 33 extends into forward insulation member 53 but not all the way through forward insulation member 53.

At the outer end of base 26, bare electrical connectors 22 provide a terminal end 20 of power cable 12. Conductor pins 18 have bores which are separately mounted and then soldered over the terminal ends 20 of bare electrical connectors 22. Conductor pins 18 are provided for mating with electrical connectors in receptacle 14 (FIG. 2) of the submersible pump motor 15 (FIG. 2). Insulation layer 24 of each conductor 22 extends up to and may abut conductor pin 18, but does not extend over conductor pin 18.

Still referring to FIG. 1, insulator members or blocks 52,53 are formed of a hard engineering grade plastic, such as polyetheretherketone (PEEK), and mounted at the forward or lower end of base 26. Insulator blocks 52,53 are fixed within base 26 to prevent axial movement within the housing 30. Insulator blocks 52,53 and seal member 54 are provided with a plurality of bores 69 (three in preferred embodiment) therethrough for electrical conductors 22 and for aligning them with the conductor pins 18. Forward insulator block 53 has a flat forward end or face 55 that is in a plane perpendicular to conductor pins 18. An elastomeric sealing boot 66 may extend around a forward lip of base 26 and provide a seal between tubular housing 30 and electrical submersible motor 15. Boot 66 is shown in FIG. 1 but not in the other figures.

At the interface between the forward end 55 of insulator 53 and each conductor pin 18 is an elastomeric O-ring end face seal 70. Inside bore 69, an optional sleeve 68 fits closely around each of conductor pins 18 and protrudes a short distance below forward face 55 of insulation block 53. Sleeve 68, if used, may be constructed to be part of conductor pins 18 and is formed of an electrically conductive metal. Each end face seal 70 encircles sleeve 68 of one of the conductor pins 18 and contacts end face 55 of insulator block 53. The inner diameter of each end face seal 70 is substantially the same as the outer diameter of sleeve 68 for each conductor pin 18.

In addition, an O-ring sleeve seal 72 may fit around each conductor pin 18 at the end or rim of each sleeve 68 to seal against any leakage between sleeve 68 and conductor pin 18. The sealing engagement is formed by the inner diameter and the rearward portion of sleeve seal 72 contacting a shoulder on conductor pin 18 and contacting the rim of sleeve 68. The outer diameter of sleeve seal 72 does not form a seal and shown as being only slightly greater in diameter than sleeve 68.

Figure 3:
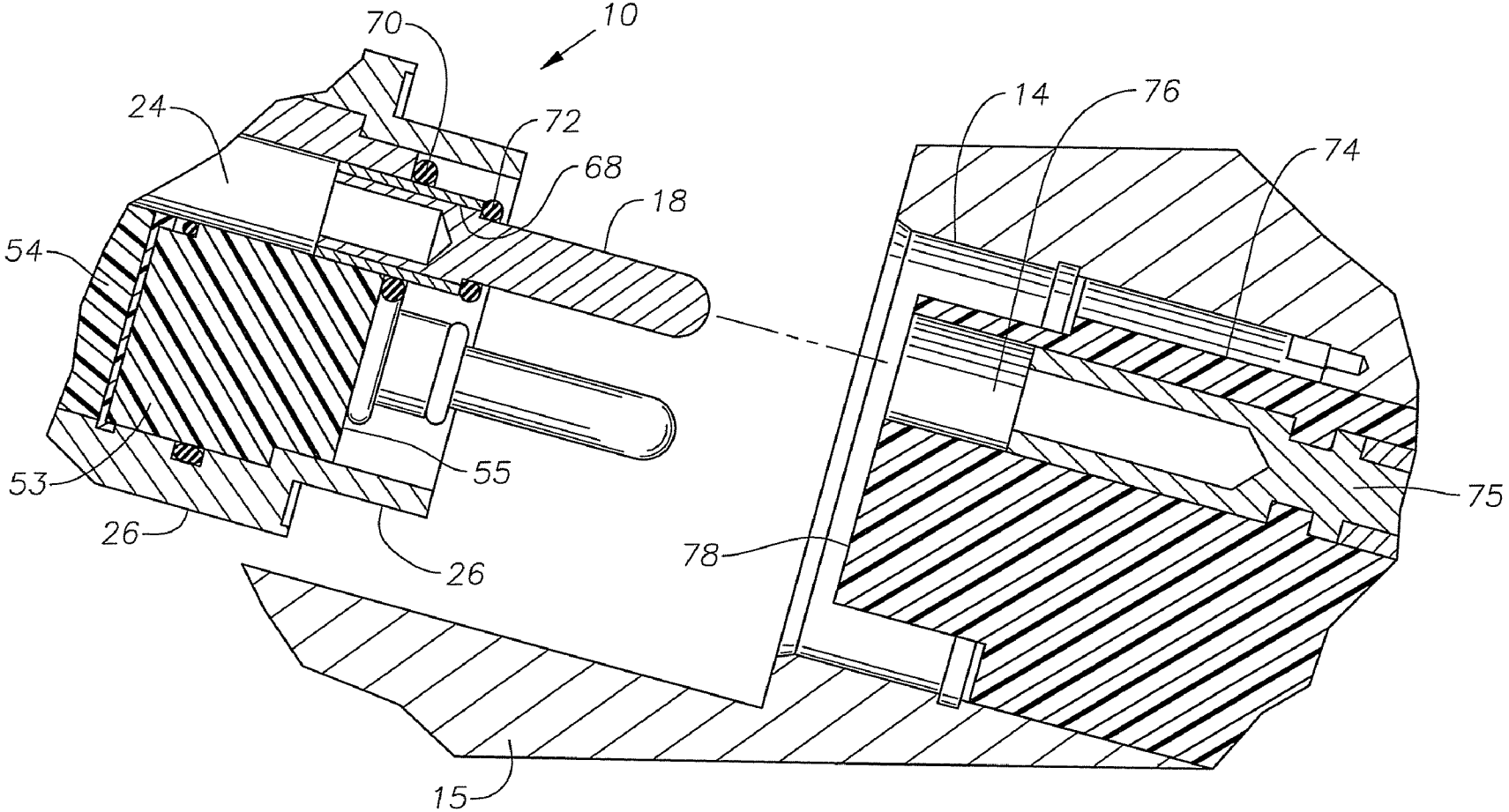
FIG. 3 is a sectional enlarged view of a portion of FIG. 2.

Referring to FIG. 3, female receptacle 14 will now be described. A receptacle block 74 of a rigid insulation material is mounted in female receptacle 14. Receptacle block 74 has a plurality of holes 76 (one shown), one for each conductor pin 18. A mating electrical conductor sleeve 75 (shown only in FIG. 3) is located within each hole 76 in receptacle block 74 to accept one of the conductor pins 18 as pothead 10 is connected to female receptacle 14. Each conductor sleeve 75 is connected to one of the wires within motor 15. Receptacle block 74 has a cylindrical portion with a diameter slightly smaller than the inner diameter of base 26 at its forward end for sliding into lip 26. Receptacle insulating member 74 has an end face 78 that is flat and parallel with end face 55 of insulating member 53.

Figure 4:
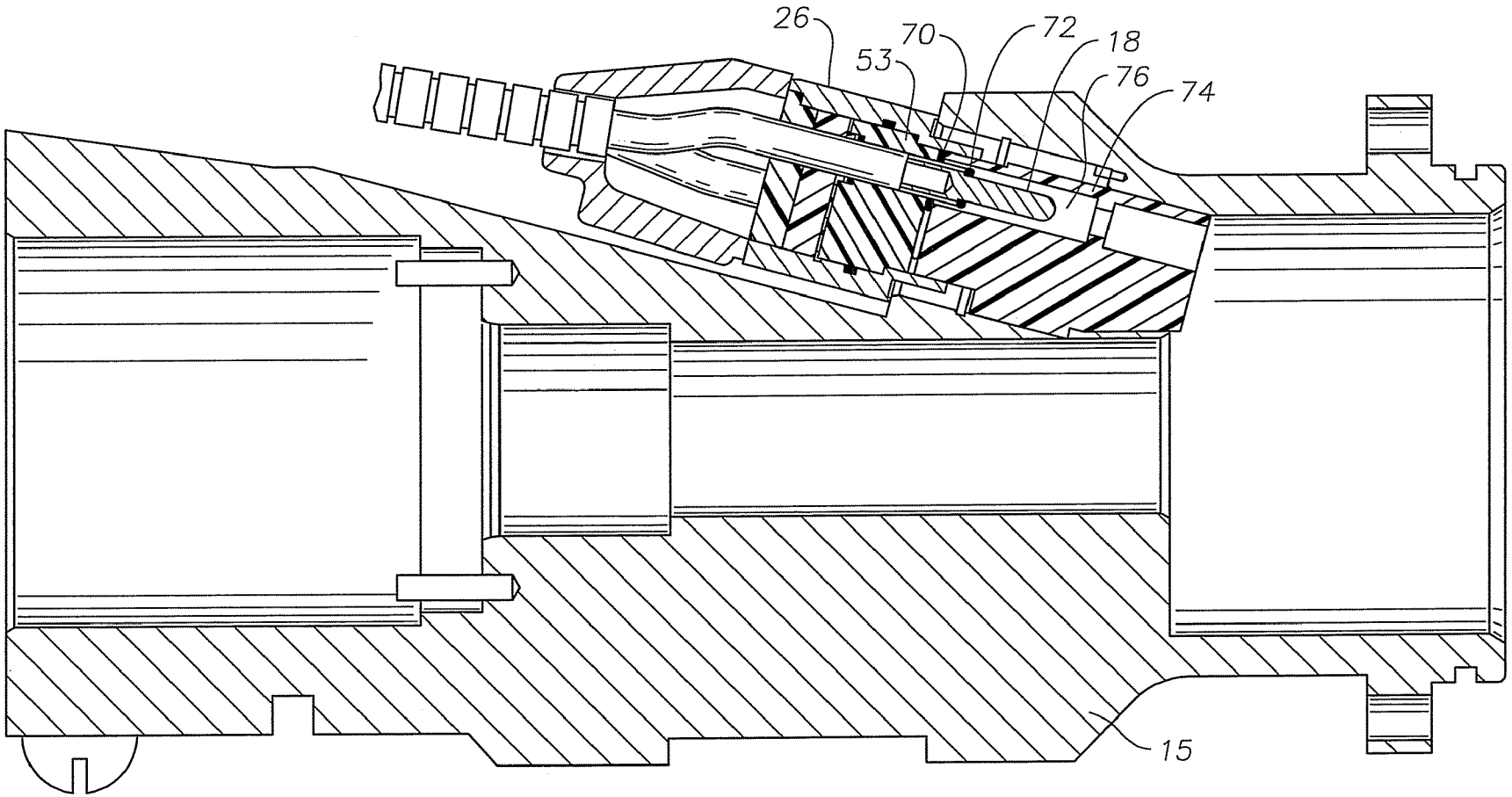
FIG. 4 is a side sectional view showing the pothead connector fully inserted into the female assembly according to an embodiment of the present invention.
Figure 5:
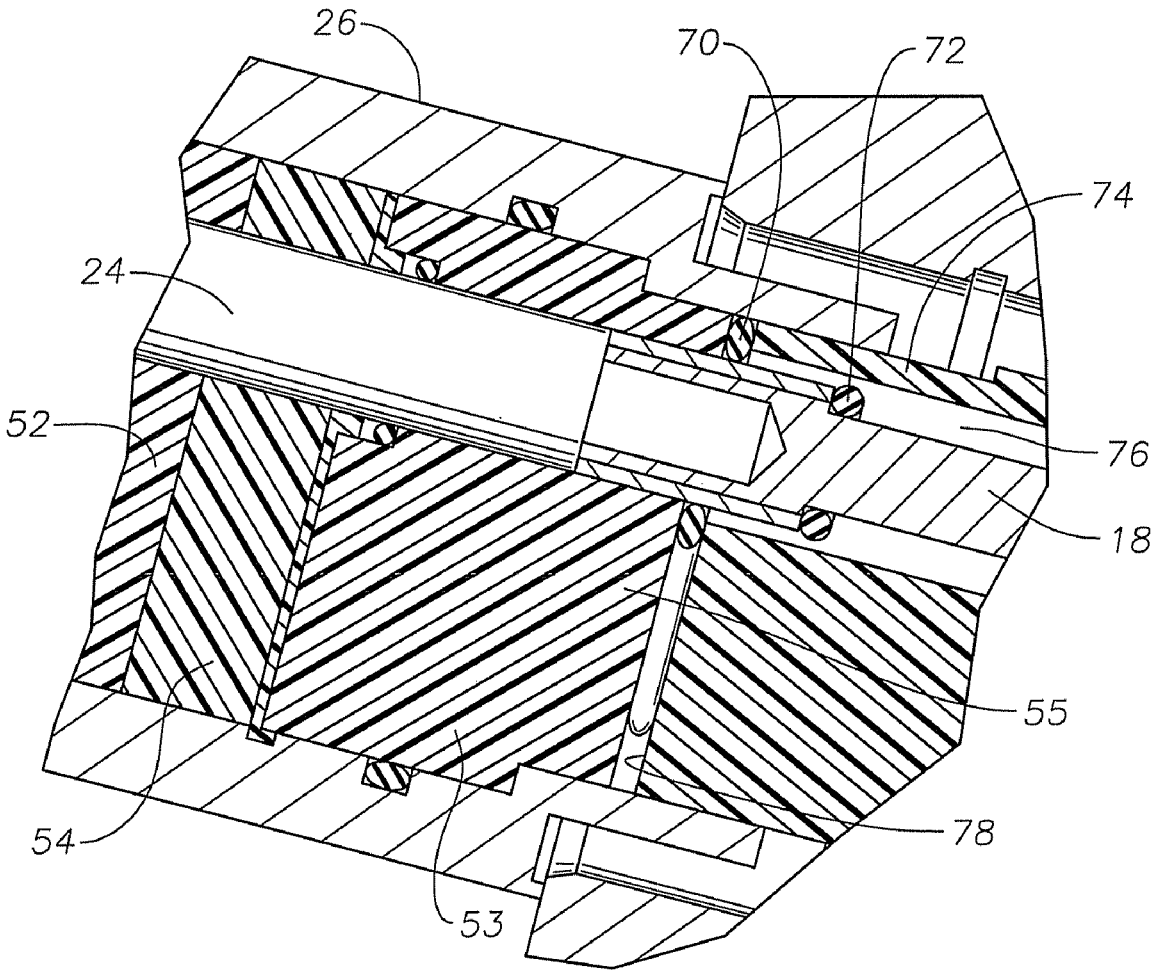
FIG. 5 is a sectional enlarged view of a portion of FIG. 4.

Referring to FIGS. 3, 4, and 5, during operation, end face seals 70, which are between face 55 of insulation member 53 and face 78 of receptacle member 74, are contacted and deformed by faces 55, 78, thereby creating an effective barrier that prevents debris from getting into the area between conductor pin 18 and pothead 10. The axial compression on each end face seal 70 causes its inner diameter to seal tightly around sleeve 68. However, the outer diameter of end face seal 70 does not form a seal. When fully connected, as shown in FIG. 5, a small clearance exists between end faces 55, 78.

When connected, sleeve seal 72 enters receptacle 76 but is not deformed by receptacle 76 because its outer diameter is smaller than the inner diameter of receptacle 76. If electrical contact sleeve 75 is sized appropriately, sleeve seal 72 may make contact with the end of electrical contact sleeve 75 to deform sleeve seal 72 against the rim of sleeve 68. The inner diameter of seal 72 forms a seal around conductor pin 18 and the rim of sleeve 68 to reduce entry of material between sleeve 68 and conductor pin 18.

The invention has significant advantages. The end face seals provide an additional barrier to the entry of contaminated material into the area of the electrical contacts. The sleeve seals, if employed, provide still another barrier.

It is to be understood that the invention is not limited to the exact details of the construction, operation, exact materials or embodiment shown and described, as obvious modifications and equivalents will be apparent to one skilled in the art. For example, the pins could be located in the receptacle and the conductor sleeves could be located in the cable end housing.

We claim:

1. An apparatus for connecting electrical power to a well pump motor;

first and second connector portions that mate with each other in a connected position, one of the connector portions adapted to be connected to a power cable and the other to a well pump motor;

the first and second connector portions having first and second insulating members, respectively, each of the insulating members having a plurality of passages and an end face;

a first electrical contact member mounted in each of the passages of and protruding past the end face of the first insulating member, the first electrical contact member having a circular cross-sectional configuration;

a second electrical contact member mounted and recessed within each of the passages of the second insulating member;

a plurality of end face seals, each end face seal having a circular inner diameter surrounding and sealingly receiving a single one of the first electrical contact members and deformed by engagement of the end face of the second insulating member when the first and second connector portions are in the connected position;

a plurality of sleeves of electrical conductive material, each of the sleeves enclosing a protruding portion of one of the first electrical contact members, each of the sleeves protruding past the end face of the first insulating member to a distance less than the protruding portion of each of the first electrical contact members; and a plurality of elastomeric sleeve seals, each of the sleeve seals extending around one of the cable contact members, in contact with an end of one of the sleeves and located within one of the passages in the second connector portion when the connector portions are in the connected position.

2. The apparatus of claim 1, wherein each of the end face seals has an outer diameter that is free of sealing engagement when the connector portions are in the connected position.

3. The apparatus of claim 1, wherein each of the sleeve seals is in contact with an end of one of the second electrical contact members when the connector portions are in the connected position.

4. The apparatus of claim 1, wherein the end faces are spaced apart from each other when the connector portions are in the connected position.

5. An apparatus for supplying electrical power to a well pump motor, comprising:

a cable end housing for connection to a power cable;

a cable insulating member of insulating material disposed within the housing and having at least one passage therethrough;

an electrical conducting cable contact member mounted in the passage of the cable insulating member and adapted to be joined to a conductor in the cable, the cable contact member protruding past an end face of the cable insulating member;

a motor insulating member of insulating material adapted to be mounted in a receptacle of an electrical motor and having at least one passages therethrough, the motor insulating member having an end face;

an electrical conducting motor contact member in the passage of the motor insulating member that is engaged by the cable contact member when the cable end housing and the receptacle are in a connected position;

an end face seal surrounding the cable contact member and sealingly deformed between the end faces of the cable insulating member and the motor insulating member when cable end housing and the receptacle are in the connected position;

a sleeve of electrical conductive material enclosing a protruding portion of the cable contact member, the sleeve being in electrical contact with the cable contact member, protruding past the end face of the cable insulating member and having a rim at a distance from the end face of the cable insulating member less than an end of the cable contact member; and an elastomeric sleeve seal extending around the cable contact member and in contact with the rim of the sleeve.

6. The apparatus according to claim 5, wherein the end faces are spaced apart from each other when the cable end housing and the receptacle are in the connected position.

7. The apparatus of claim 5, wherein the end face seal has an inner diameter that seals to an outer diameter of the cable contact member.

8. The apparatus of claim 5, wherein the end face seal has an outer diameter that is free of sealing engagement.

9. The apparatus of claim 5, wherein the sleeve seal extends into the passage of the motor insulating member and is contacted by an end of the motor contact member and forced against the rim of the sleeve.

10. The apparatus of claim 5, wherein the sleeve seal has an outer diameter smaller than a diameter of the passage in the motor insulating member.

11. An apparatus for supplying power to a well pump motor, comprising:

a cable end housing for connection to a power cable;

a cable insulating member of rigid insulating material disposed within the housing and having a plurality of passages therethrough;

a plurality of electrical conducting cable contact members, each of the cable contact members being mounted in one of the passages of the cable insulating member and adapted to be joined to a conductor in the cable, each of the cable contact members protruding past an end face of the cable insulating member;

a plurality of annular elastomeric end face seals, each of the end face seals extending around one of the cable contact members and in contact with the end face of the cable insulating member; and a receptacle for connection to a well pump;

a motor insulating member of rigid insulating material mounted in the receptacle and having a plurality of passages therethrough;

motor contact member in each of the passages of the motor insulating member and positioned to be engaged by one of the cable contact members when the housing and the receptacle arc in a connected position;

the motor insulating member having an end that contacts and deforms the end face seals against the end of the cable insulating member when the housing and the receptacle are in the connected position;

a plurality of sleeves of electrical conductive material, each of the sleeves enclosing a protruding portion of one of the cable contact members, each of the sleeves having a portion located within one of the passages of the cable insulating member and another portion protruding past the end of the cable insulating member, each of the sleeves having a rim located a distance from the end face of the cable insulating member less than less than an end of each of the cable contact members; and a plurality of elastomeric sleeve seals, each of the sleeve seals extending around one of the cable contact members and in contact with the rim of one of the sleeves when the housing and the receptacle are in the connected position.

12. The apparatus of claim 11, wherein each of the sleeve seals is contacted and deformed against the rim of one the sleeves by an end of one of the motor contact members when the housing and the receptacle are in the connected position.

13. The apparatus of claim 11, wherein each of the sleeve seals has an outer diameter less than an outer diameter of each of the passages in the motor insulating member.

14. The apparatus according to claim 11, wherein the end faces are spaced apart from each other when the housing and the receptacle are in the connected position.

15. The apparatus of claim 11, wherein each of the end face seals has an inner diameter that seals to an outer diameter of the cable contact member.

16. The apparatus of claim 11, wherein each of the end face seals has an outer diameter that is free of sealing engagement.

* * * * *

UNITED STATES PATENT AND TRADEMARK OFFICE

CERTIFICATE OF CORRECTION

PATENT NO. : 7,575,458 B2
APPLICATION NO. : 11/853965
DATED : August 18, 2009
INVENTOR(S) : Larry J. Parmeter et al.

It is certified that error appears in the above-identified patent and that said Letters Patent is hereby corrected as shown below:

Column 1, line 45, delete "in" before "the" and insert --if--
Column 1, line 63, delete "seals" and insert --seal--
Column 6, line 27, delete "less than" (second occurrence)

Signed and Sealed this

First Day of December, 2009

David J. Kappos

David J. Kappos
*Director of the United States Patent and Trademark Office*